US006595709B2

(12) United States Patent
Cassiano

(10) Patent No.: US 6,595,709 B2
(45) Date of Patent: Jul. 22, 2003

(54) SERIAL PRINTING DEVICE

(75) Inventor: Cosimo Cassiano, Vittuone (IT)

(73) Assignee: Compuprint SpA, Turin (IT)

( * ) Notice: Subject to any disclaimer, the term of this patent is extended or adjusted under 35 U.S.C. 154(b) by 0 days.

(21) Appl. No.: 10/071,344

(22) Filed: Feb. 8, 2002

(65) Prior Publication Data

US 2002/0110395 A1 Aug. 15, 2002

(30) Foreign Application Priority Data

Feb. 9, 2001 (IT) ..... UD2001A0021

(51) Int. Cl.[7] ..... B41J 11/20
(52) U.S. Cl. ..... 400/56; 400/55; 400/58
(58) Field of Search ..... 400/55, 56, 57, 400/58, 59, 283, 652; 347/198

(56) References Cited

U.S. PATENT DOCUMENTS 5,172,137 A * 12/1992 Hongo et al. ..... 347/198
5,499,876 A 3/1996 Hosokawa et al.
5,879,091 A 3/1999 De Ambrogio et al.
5,918,990 A * 7/1999 Abumehdi ..... 400/120.17
6,155,731 A * 12/2000 Bertalan et al. ..... 400/621

FOREIGN PATENT DOCUMENTS

| | | |
|---|---|---|
| EP | 0 854 049 A2 | 7/1998 |
| JP | 63 188074 A | 8/1988 |
| JP | 63 188075 A | 8/1988 |

OTHER PUBLICATIONS

"Platen Mechanism for Passbook/Cutform Printer," IBM Technical Disclosure Bulletin, IBM Corp., New York, U.S., vol. 38, No. 11, p. 109 (Nov. 1995).

* cited by examiner

*Primary Examiner*—Andrew H. Hirshfeld
*Assistant Examiner*—Dave A. Ghatt
(74) *Attorney, Agent, or Firm*—Akin Gump Strauss Hauer & Feld, L.L.P.

(57) ABSTRACT

A serial printing device, comprising a fixed structure, a printing carriage on one side of the fixed structure able to slide along a printing line, and a contrasting element disposed on the other side of the fixed structure. A printing element is disposed on the printing carriage and is associated with a reference element able to contact the surface of the printing support. First elastic elements are disposed between the printing element and the printing carriage and second elastic elements are disposed between the contrasting element and the fixed structure.

12 Claims, 4 Drawing Sheets

SERIAL PRINTING DEVICE

FIELD OF THE INVENTION

The invention refers to a serial printing device able to allow a printing head to automatically position itself at a set distance from a contrasting element, according to the thickness of the document introduced into the printer. The document can consist of a sheet of paper, thick or thin, or a booklet composed of several pages, such as for example a passport, a post office savings book, a bank book, a data processing table or suchlike. The printing head can be of the impact type, for example with needles, or without impact, for example of the ink-jet type.

BACKGROUND OF THE INVENTION

In serial printers, especially but not only impact-type printers, one of the most serious technical problems is to take the writing element, whether it be a printing head with needles, ink-jet or otherwise, to a set distance from the printing support; this distance is usually in the range of several tenths of a millimeter.

The state of the art includes printing devices wherein the contrasting element, or platen, is assembled in a fixed position on a supporting structure, while the writing assembly, or writing element, is assembled on a carriage which can move with respect to the platen, drawing nearer to it or moving farther from it, according to the thickness of the printing support.

The state of the art also includes devices wherein, vice versa, the writing element and the carriage have a fixed position with respect to the writing plane, and it is the platen which can move, backwards and forwards, with respect to said writing plane.

Apart from printers with a low quality level, where the operator can vary the distance manually, in high-quality professional printers this operation is carried out automatically by means of sensors, sometimes even sophisticated and expensive ones, which detect the thickness of the document introduced between the contrasting element and the writing element. These sensors are assembled either in a fixed position or on board the printing carriage.

Moreover, since the document, as in the case of booklets, could have a variable thickness within the same printing line, before printing a line, the printing carriage on which the sensor is assembled is sometimes made to translate to make it perform a service travel along the entire printing line, in order to detect and memorize the possible variations in thickness. In a subsequent travel, possibly made backwards, the carriage or platen, by means of complex and expensive servo mechanisms, are displaced with respect to each other, according to the thickness detected.

Until today, at least in the field of office printers, no-one has ever invented a serial printing device which will allow the writing element and the platen to vary their reciprocal position, simply and automatically, according to the thickness of the printing support, also along the same printing line.

Document JP-A-63-188074 discloses a printing device comprising a printing head mounted on a carriage and pressed by a first spring towards a stationary reference rail disposed parallel to a platen. When the carriage moves parallel to the platen, the printing head also slides on the reference rail parallelly to the platen. The latter has a circular surface which is pressed towards the stationary reference rail by a second spring. The platen, against the action of such second spring, displaces with respect to the reference rail corresponding to the thickness of the printing paper interposed between the platen and the same reference rail.

Document JP-A-63-188075 discloses a printing device comprising a printing head mounted on a carriage and pressed by a first spring towards a stationary reference rail. A pair of rollers are connected therebetween by means of a lever and are disposed parallel to the reference rail. When the carriage moves parallel to the rollers, the printing head also slides on the reference rail parallelly to the rollers. A first of such two rollers is pressed towards the reference rail by a second spring. The two rollers, against the action of such second spring, displace with respect to the reference rail corresponding to the thickness of the printing paper interposed between the first roller and the same reference rail.

Both these two above-mentioned printing devices have the disadvantage not to permit the printing head to displace with respect to the platen/rollers to adapt perfectly to the variations in thickness, even within the same line, of the printing document, particularly when the latter consists of a booklet composed of several pages, such as for example a passport, a post office savings book, a bank book or suchlike.

The present Applicant has devised and embodied the serial printing device according to the invention to overcome the shortcomings of conventional devices and to obtain further advantages, which are set out hereafter.

SUMMARY OF THE INVENTION

The invention is set forth and characterized in the main claim, while the dependent claims describe other innovative characteristics of the invention.

The main purpose of the invention is to achieve a device which will enable a serial printing element to adapt perfectly to the variations in thickness, even within the same line, of the document it has to print on, especially in the case that the latter consists of a booklet composed of several pages, such as for example a passport, a post office savings book, a bank book or suchlike, without using sophisticated sensors or servo mechanisms.

In accordance with this purpose, the printing device according to the invention comprises a fixed structure on one side of which a printing carriage, able to slide along the printing line, and on the other side a contrasting element are assembled. A printing element is in turn assembled on the carriage. According to a characteristic feature of the invention, a reference element is associated with the printing element, and is able to contact the surface of the paper support to be printed on, first elastic means are disposed between the printing element and the carriage and second elastic means are disposed between the contrasting element and the fixed structure.

The reference element is disposed very near the writing end of the printing element and substantially coplanar thereto. Consequently, the reference element, coming into contact with the surface to be printed on, in fact also determines the distance between the latter and the printing element.

The reference element advantageously comprises a wheel solid with the printing element, so that its cylindrical surface is substantially tangent to a writing plane which also passes through the writing ends of the printing element.

The parameter of rigidity of the above-mentioned first elastic means is less than that of the second elastic means, so that when the thickness of the documents which have to be printed on is contained within a set value, only the first elastic means are suitable to yield. In this case it is only the printing element which moves with respect to the carriage, while the contrasting element remains still. On the contrary, when the thickness of the document exceeds this set value, the second elastic means also yield and consequently the contrasting element too is distanced from the printing element with respect to its initial inactive position.

The device is therefore self-adapting and requires neither sensors nor servo mechanisms to regulate the distance of the printing element from the contrasting element, that is, the head from the platen.

Moreover, the different thicknesses of the document to be printed on are immediately recognized, even within the same printing line, allowing the device according to the invention to treat any type of document.

There is therefore no constraint either on the positioning of the document introduced nor on the size of the document.

The fact that the contrasting element too can move elastically after the printing element has already made a certain travel means that the possible introduction of a particularly thick document, such as for example a passport, does not damage the printing element in the least, because the difference between the thickness of the document and the above-mentioned travel is absorbed by the yielding of the contrasting element.

The device according to the invention also obtains a breaking of the critical printing frequencies, with a consequent reduction in noise, and also rapidly damps the oscillations, due to the displacement of the two mechanical elements (printing element and contrasting element).

BRIEF DESCRIPTION OF THE DRAWINGS

These and other characteristics of the invention will be apparent from the following description of a preferential form of embodiment, given as a non-restrictive example with reference to the attached drawings wherein.

DETAILED DESCRIPTION OF A PREFERENTIAL EMBODIMENT

Figure 1:
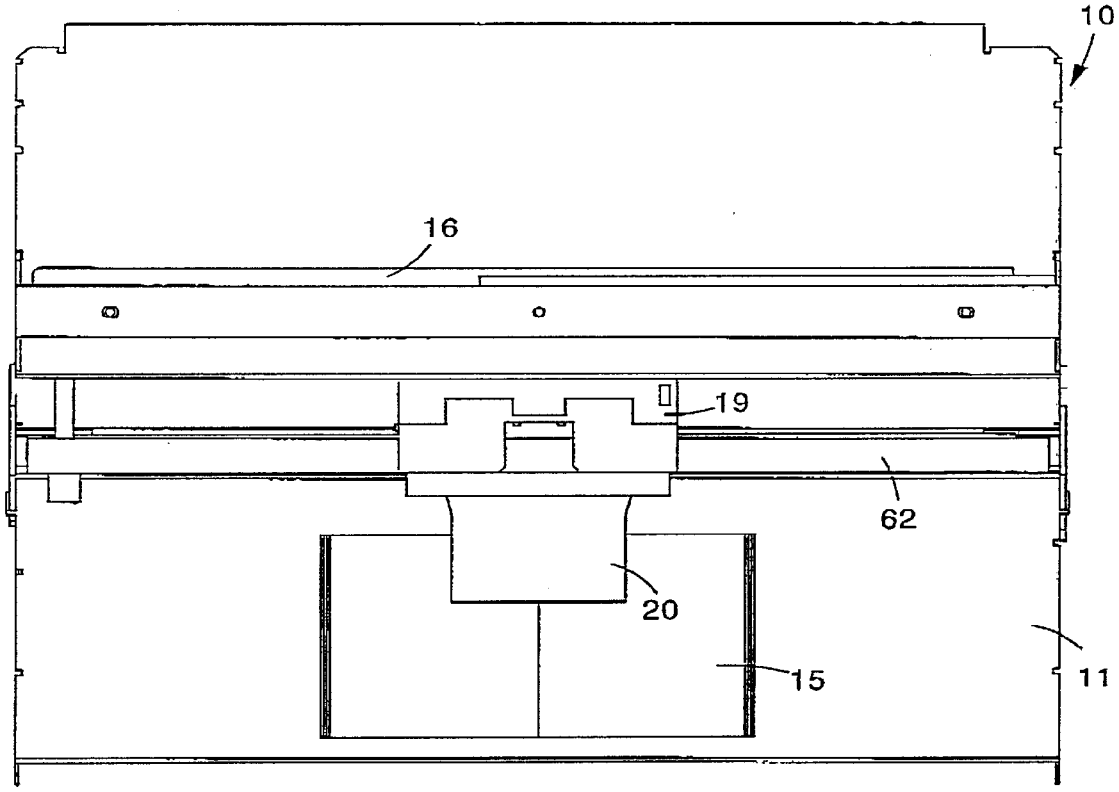
FIG. 1 is a plane view of a printing device according to the invention.
Figure 2:
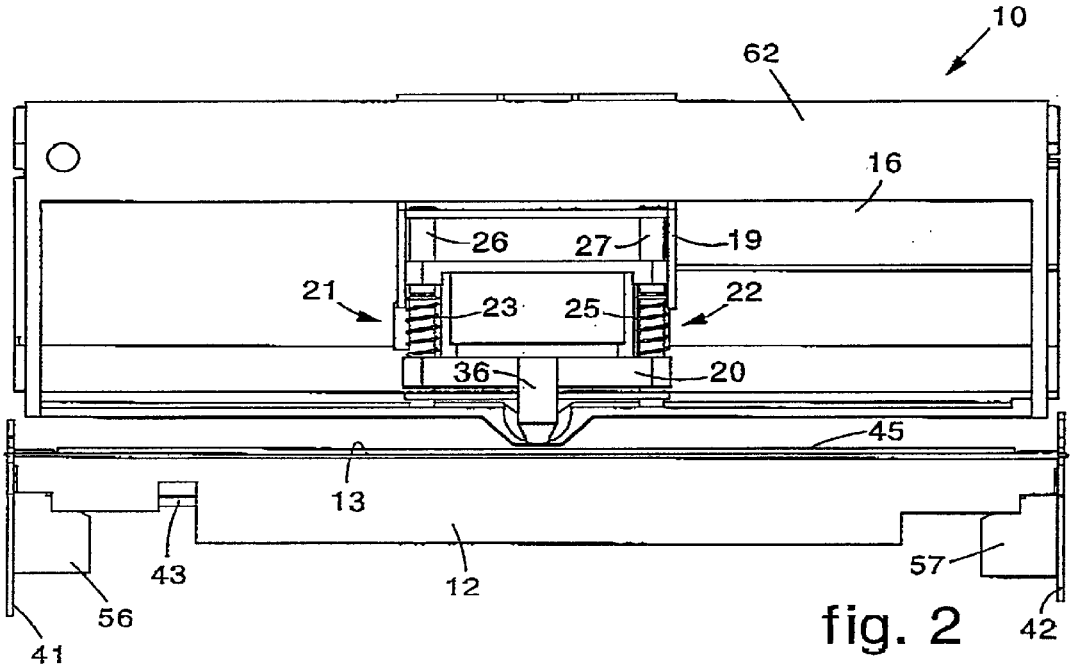
FIG. 2 is a front view of the device in FIG. 1.
Figure 3:
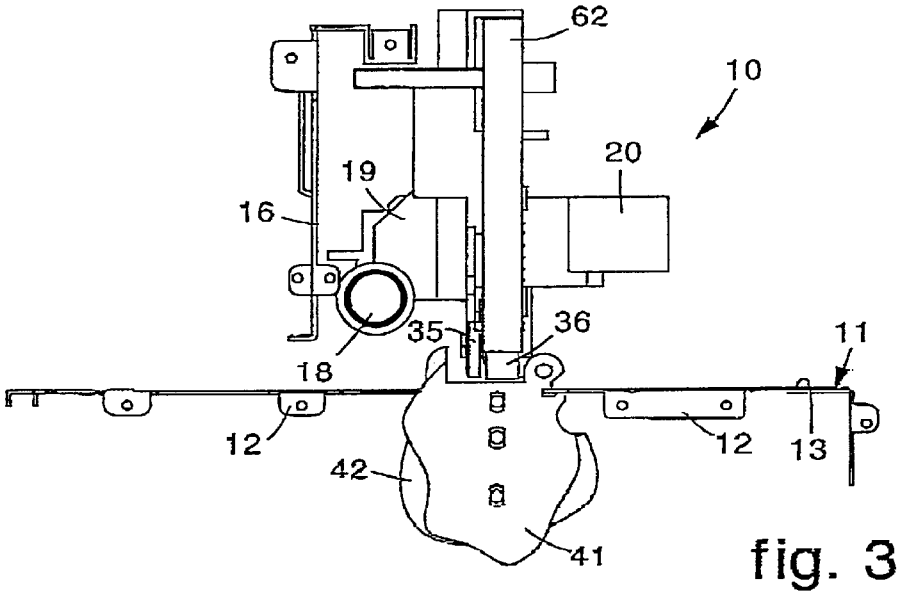
FIG. 3 is a left side view of the device in FIG. 1.
Figure 4:
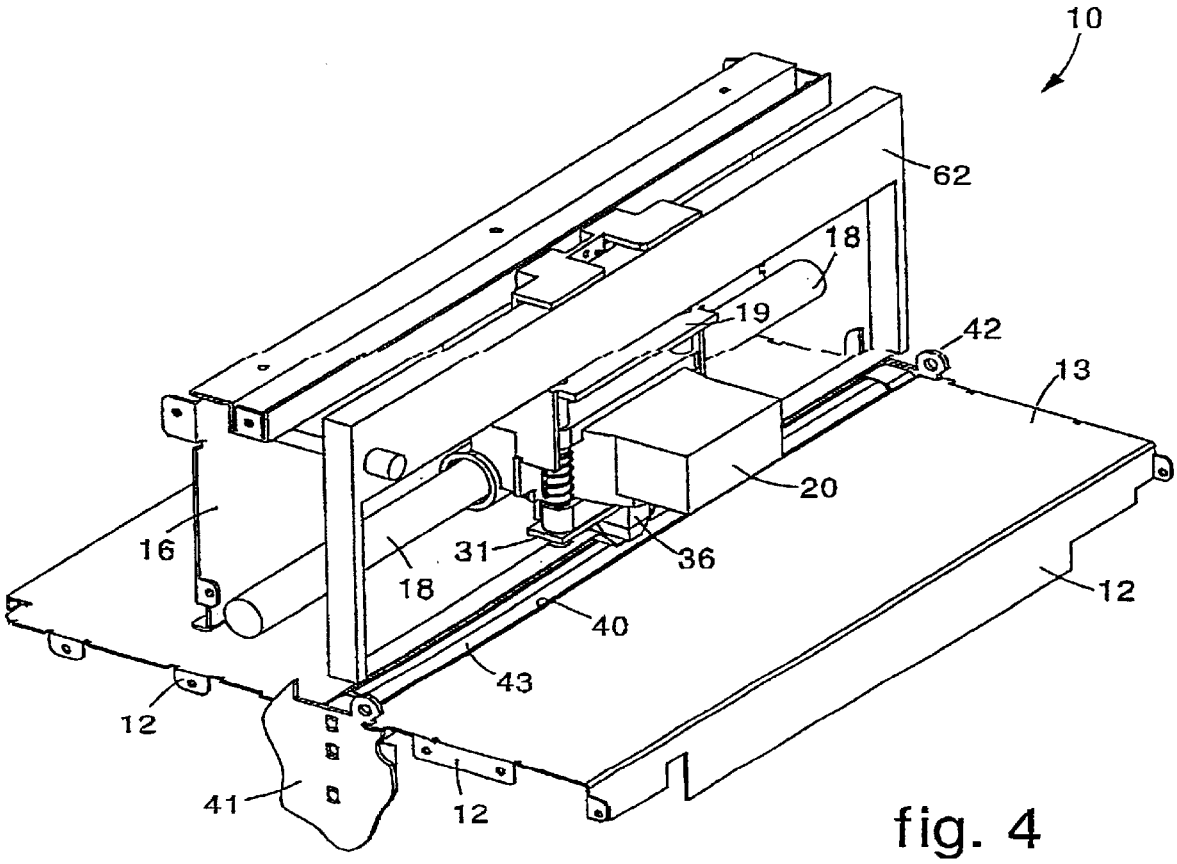
FIG. 4 is a prospective view of the device in FIG. 1.
Figure 5:
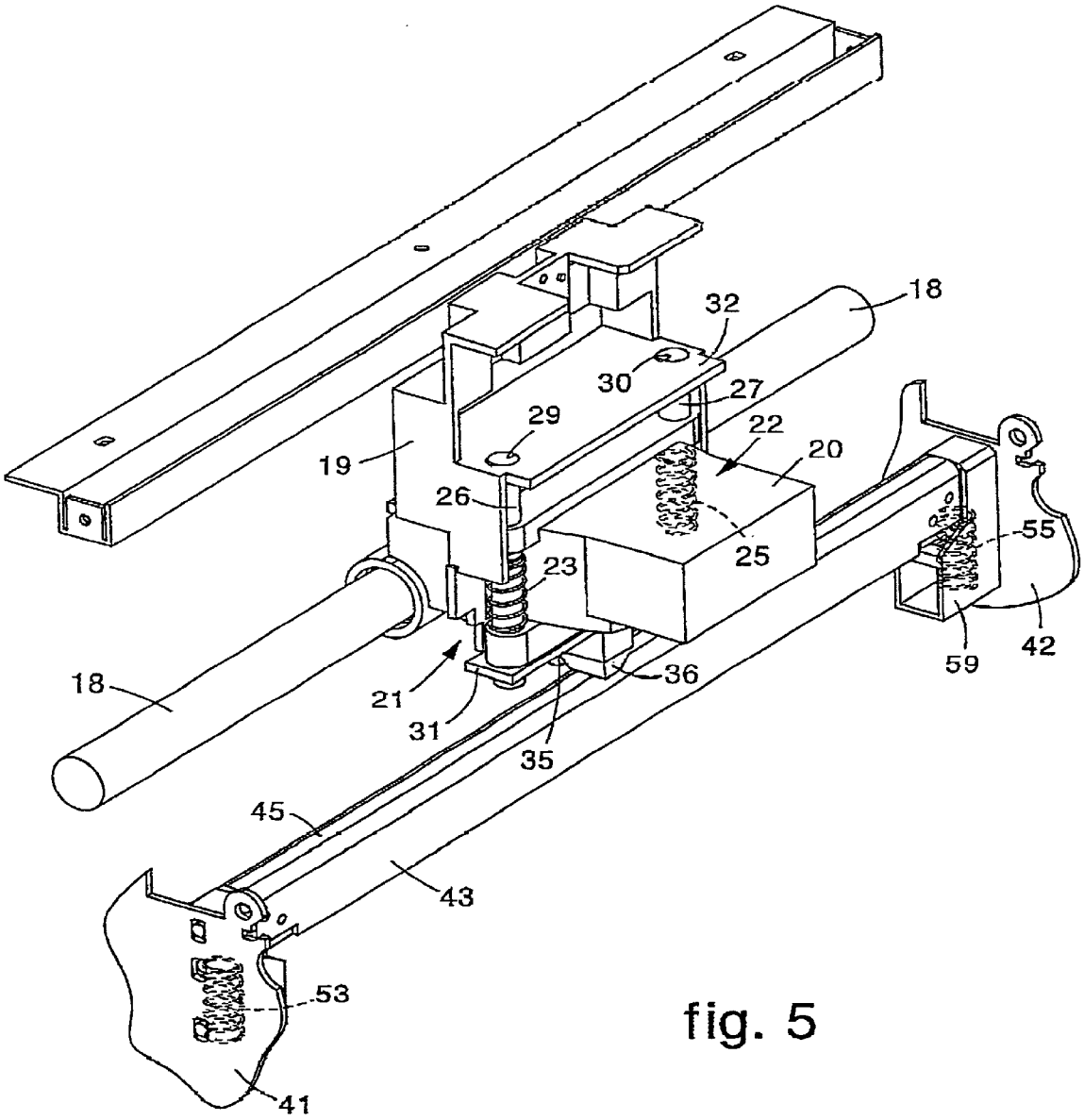
FIG. 5 is an enlarged detail of FIG. 4.
Figure 6:
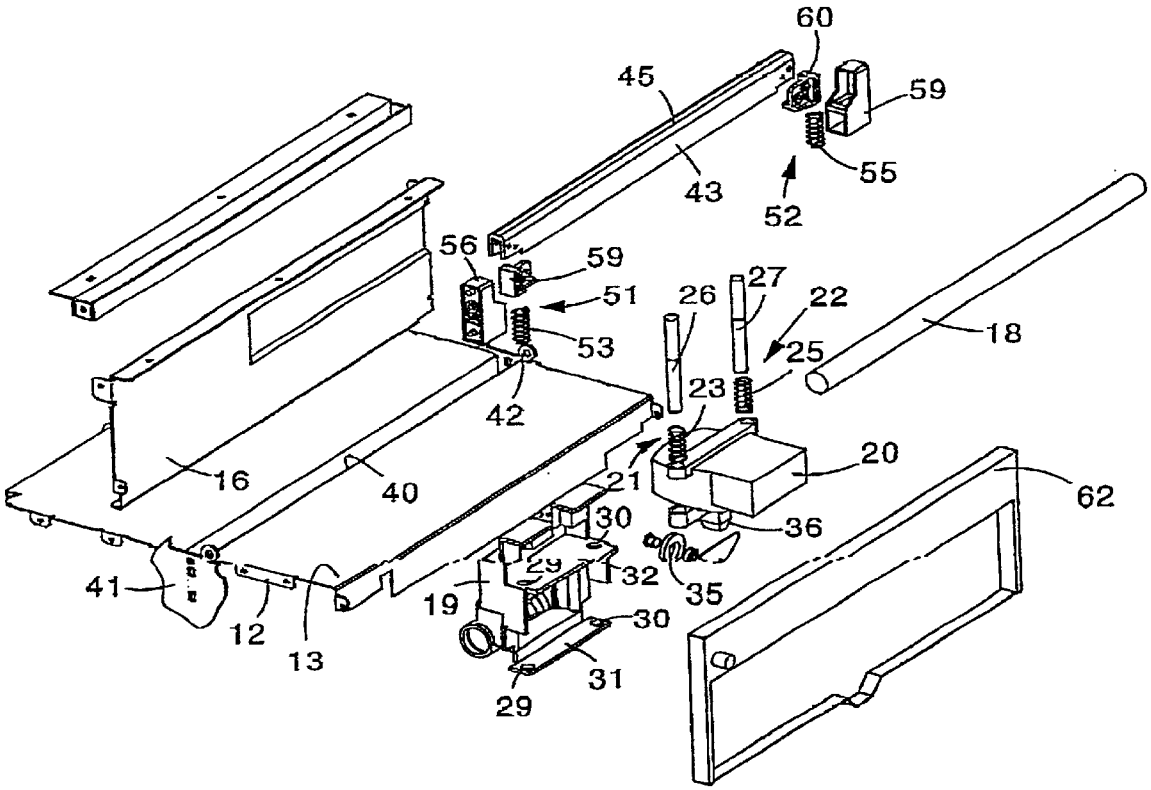
FIG. 6 is an exploded view of the device in FIG. 1.

With reference to the attached Figures, a printing device 10 according to the invention comprises a fixed structure 11, consisting essentially of a lower metal plate 12, shaped so as to define a horizontal surface 13, on which a printing support or document to be printed 15 is able to rest, and an upper part 16. The latter comprises a cylindrical bar 18 with the longitudinal axis disposed horizontally, on which a printing carriage 19 is able to slide, commanded by an electric motor of a conventional type and therefore not shown in the drawings.

On the printing carriage 19 a printing head 20 is assembled, of a conventional type, for example with needles of the type described in the Italian patent application UD2000A000110 which the present Applicant filed on May 30, 2000.

According to a characteristic feature of the invention, the printing head 20 is assembled on the carriage 19 by means of two first elastic suspensions 21 and 22, disposed at the sides of the head 20. To be more exact, each suspension 21, 22 comprises a helical spring 23, respectively 25, disposed coaxial with a cylindrical rod 26, respectively 27, having the extremities housed in corresponding seatings 29 and 30 made on horizontal cross-pieces 31 and 32 of the carriage 19.

A wheel 35 is assembled rotatable on the printing head 20 near the writing end 36 of the latter, in which, in conventional fashion, the writing elements (not visible in the drawings) are disposed. To be more exact, the lower part of the cylindrical surface of the wheel 35 is substantially tangent to, or a little below, a horizontal plane which also passes through the writing elements of the printing head 20.

A horizontal throat 40 is made on the metal plate 12, in correspondence with the printing line, along which the end 36 of the printing head 20 slides.

Two vertical plates 41 and 42 are assembled on the lower plate 12 at the lateral ends of the horizontal throat 40 and are able to support a contrasting bar, or platen 43, with a substantially horizontal upper surface 45.

The platen 43 is assembled on the plates 41 and 42 by means of two second elastic suspensions 51 and 52, each of which comprises a helical spring 53, respectively 55, compressed between a supporting block 56 respectively 57, and a contrasting block 59, respectively 60, attached to the corresponding lateral end of the contrasting bar 43, below the surface 45.

The parameter of rigidity ($K_1$) of the helical springs 53 and 55 is greater than that ($K_2$) of the helical springs 23 and 25. Advantageously, $K_1$ is between about 0.8 and 2.0 N/mm, specifically 1.0 N/mm, while $K_2$ is between about 0.6 and 1.2 N/mm, specifically 0.8 N/mm.

The printing device 10 also comprises a cartridge of ink tape 62, of conventional type, which is able to be removably assembled on the upper part 16 of the fixed structure 11, so that the tape contained therein has at least a portion which, in use, is constantly disposed between the writing elements of the printing head 20 and the contrasting bar 43.

The printing device 10 as described heretofore functions as follows:

In the inactive condition, the carriage 19 and the printing head 20 are positioned at one end of the fixed structure 11, outside the printing zone.

The printing support 15, whatever it may be and no matter how thick, is rested on the upper surface 13 of the plate 12 and made to advance horizontally to take it to the printing line, above the contrasting bar 43. This advance can be achieved either manually or automatically by means of any conventional means, not shown in the drawings.

To print on the support 15, the printing carriage 19 is translated along the printing line. The wheel 35, solid with the printing head 20, slides on the document 15, detects the relative thicknesses thereof and consequently commands the vertical movement of the head 20 with respect to the carriage 19, against the action of the upper helical springs 23 and 25. The fixed constraint between the wheel 35 and the head 20 guarantees a constant and pre-determined distance between the printing elements and the surface of the underlying document 15 to be written on, that is to say, it guarantees optimum printing conditions.

If the document 15 has a thickness greater than a set value, in the range of several millimeters, in addition to the vertical movement of the head 20 with respect to the carriage 19, the contrasting bar 43 also lowers against the action of the lower helical springs 53 and 55. In this way the displacement due to the thickness of the document 15 is shared between the printing head 20 and the contrasting bar 43.

It is clear that modifications and additions can be made to the printing device 10 as described heretofore, without departing from the spirit and scope of the invention. For example, the wheel 35 can be replaced by a slide attached to the printing head 20.

It is also clear that, although the invention has been described with reference to a specific example, a skilled person shall certainly be able to achieve many other equivalent forms of printing device, all of which shall come within the field of this invention.

What is claimed is:

1. A serial printing device, comprising a fixed structure, a printing carriage disposed on one side of said fixed structure and able to slide along a printing line, a contrasting element disposed on the other side of said fixed structure, and a printing element disposed on said printing carriage, wherein said printing element is associated with a reference element able to contact the surface of the printing support, wherein first elastic means are disposed between said printing element and said printing carriage, wherein second elastic means are disposed between said contrasting element and said fixed structure, and wherein the parameter of rigidity ($K_1$) of said second elastic means is greater than that ($K_2$) of said first elastic means.

2. A serial printing device as in claim 1, wherein said reference element is disposed very near the writing end of said printing element and substantially coplanar thereto.

3. A serial printing device as in claim 1, wherein said printing element comprises a head with needles.

4. A serial printing device as in claim 1, wherein said reference element comprises a wheel.

5. A serial printing device as in claim 4, wherein the lower part of the cylindrical surface of said wheel is substantially tangent to, or a little below, a horizontal plane also passing through the writing elements of said printing element.

6. A serial printing device as in claim 1, wherein said first elastic means comprise first elastic suspensions disposed at the sides of said printing element.

7. A serial printing device as in claim 6, wherein each of said first elastic suspensions comprises a helical spring disposed coaxial with a cylindrical element assembled on said printing carriage.

8. A serial printing device as in claim 1, wherein said second elastic means comprise second elastic suspensions disposed substantially at the ends of said contrasting element.

9. A serial printing device as in claim 8, wherein each of said second elastic suspensions comprises a helical spring compressed between a supporting element attached to said fixed structure and a contrasting block attached to a corresponding lateral end of said contrasting element.

10. A serial printing device as in claim 1, wherein the parameter of rigidity ($K_1$) of said second elastic means is between about 0.8 and 2.0 N/mm, while that ($K_2$) of said first elastic means is between about 0.6 and 1.2 N/mm.

11. A serial printing device as in claim 10, wherein the parameter of rigidity ($K_1$) of said second elastic means is 1.0 N/mm.

12. A serial printing device as in claim 10, wherein the parameter of rigidity ($K_2$) of said first elastic means is 0.8 N/mm.

* * * * *